United States Patent [19]

Cearfoss

[11] Patent Number: 5,046,985

[45] Date of Patent: Sep. 10, 1991

[54] DOLL WITH A FACE FLAP OVERLYING A MARKABLE FACE PLATE

[76] Inventor: Roscoe Cearfoss, 805 Camino La Posada, Camarillo, Calif. 93010

[21] Appl. No.: 630,237

[22] Filed: Dec. 19, 1990

[51] Int. Cl.[5] ..... A63H 3/12; A63H 3/00; A63H 3/02; B43L 1/00

[52] U.S. Cl. ..... 446/321; 446/74; 446/337; 446/372; 446/146; 434/414

[58] Field of Search ..... 446/72, 74, 75, 321, 446/337, 339, 340, 369, 370, 371, 372, 146; 434/410, 413, 414

[56] References Cited

U.S. PATENT DOCUMENTS

| | | | |
|---|---|---|---|
| 560,485 | 5/1896 | Eiker | 434/85 |
| 966,127 | 8/1910 | Samstag | 446/321 |
| 1,175,225 | 3/1916 | Bleeker | 434/433 X |
| 1,555,644 | 9/1925 | Duncan | 446/321 |
| 1,581,382 | 4/1926 | Buchtrup | 446/268 X |
| 1,730,177 | 10/1929 | Van Cleave | 446/385 X |
| 1,926,139 | 9/1933 | Browne | 446/321 X |
| 1,935,353 | 11/1933 | Coventry | 434/84 |
| 1,942,370 | 1/1934 | Jacobson | 434/85 X |
| 2,019,516 | 11/1935 | Weinberg | 446/100 |
| 2,199,049 | 4/1940 | Greenberg | 446/100 |
| 2,327,059 | 8/1943 | Pal | 446/391 X |
| 2,367,608 | 1/1945 | Ponnock | 434/410 |
| 2,508,771 | 9/1952 | Sparks | 434/410 |
| 3,040,447 | 6/1962 | Baldanza | 446/147 X |
| 3,180,054 | 4/1965 | Knott | 446/337 |
| 3,234,681 | 2/1966 | De Lucia | 446/100 |
| 3,406,482 | 10/1968 | Ryan et al. | 446/304 |
| 3,512,273 | 5/1970 | Baker, Jr. | 434/410 X |
| 3,729,865 | 5/1973 | Naunheim | 446/72 |
| 3,783,553 | 1/1974 | Goozner | 446/372 |
| 3,811,220 | 5/1974 | Glass et al. | 496/321 |
| 3,861,078 | 1/1975 | Snyder | 446/72 |
| 3,863,386 | 2/1975 | Kinberg | 434/410 X |
| 4,336,665 | 6/1982 | Moreau | 446/321 |
| 4,573,927 | 3/1986 | Newman | 446/321 X |
| 4,842,565 | 6/1989 | von Philp, Sr. | 446/321 |

FOREIGN PATENT DOCUMENTS

| | | | |
|---|---|---|---|
| 531847 | 1/1922 | France | 446/321 |
| 112406 | 1/1918 | United Kingdom | 446/321 |
| 2013508 | 8/1979 | United Kingdom | 446/321 |

*Primary Examiner*—David N. Muir
*Attorney, Agent, or Firm*—Kenneth J. Hovet

[57] ABSTRACT

A doll is provided having a permanently imprinted doll face on a flap overlying a blank face plate. When the flap is in a down position, the doll is played-with in a conventional manner. When the flap is raised, the plate is revealed and the child can draw face designs on the plate. A first set of facial features and related decorative items such as hair arrangements, bonnets, bows and the like are displayed when the flap overlies the plate. A corresponding second set of the above become revealed when the flap is lifted. The flap includes straps which releasably secure the flap when positioned over the face plate or, over the doll head back side.

6 Claims, 2 Drawing Sheets

DOLL WITH A FACE FLAP OVERLYING A MARKABLE FACE PLATE

BACKGROUND OF THE INVENTION

1. Field of the Invention

The invention relates to toy dolls and, more particularly, to dolls having changeable faces.

2. Description of Related Art

Dolls can be used not only as an entertainment device but also as a means to encourage creative thought and/or to educate children. U.S. Pat. No. 1,926,139 describes a doll having removable hoods imprinted with music notes, alphabet letters and deportment slogans. The hoods are used in conjunction with a teacher's instructions and are used to enhance the learning process.

A doll having a mirror face is shown in U.S. Pat. No. 3,729,865. When a child sees his/her own face on the doll, it helps to endear the child to the doll.

There are other educational dolls which utilize a variety of exchangeable facial features for attachment to a generic doll head. Some representative examples are shown in U.S. Pat. Nos. 3,210,884 (magnetic attachment of doll featurettes), 2,959,891 (adhesive attachment), 2,019,516 (pin attachments). In all of the above doll assemblies, the facial features are premade. As a result, the number of possible expressions is significantly limited.

A child may create his/her own design on the blank doll face of U.S. Pat. No. 3,863,386. There, a stylus is used to draw faces on a clear overlay above a wax backing plate. In a somewhat similar fashion, U.S. Pat. No. 3,783,553 teaches the use of a doll with a blank plastic face which can be marked with crayons. The crayon markings can be wiped-off for subsequent redrawing.

For children who do not wish to draw, U.S. Pat. No. 1,942,370 shows a generic doll head which is provided with pockets at discrete locations. Clay or moldable plastic is adhered to the pockets and shaped by the child. In this manner, the child can create various types of expressions.

A problem with many of the above dolls is that the premade facial features frequently get damaged of lost. Without all the working parts, a child will quickly loose interest. Also, the limited number of possible expressions can result in early boredom for the child.

When confronted with the aforementioned blank-faced dolls, a child will initially be perplexed and feel uncomfortable with the total absence of a smiling or otherwise friendly face. Certainly a child will not feel warmth toward, or be encouraged to hold, or to play with, or to a ask a parent to purchase, a faceless doll.

With the pocketed head and clay insert doll, the clay if uncovered, is messy and can be very difficult for younger children to handle. Also, grotesque faces can result and the child's attempts to mold realistic facial features become a source of frustration. As a result, the child's playtime becomes a negative experience.

SUMMARY OF THE INVENTION

The present invention combines the attention holding features of a toy doll with the means for stimulating and releasing a child's creative thought processes. The doll of the invention has an overt appearance similar to other cuddly attractive dolls. The subject doll includes a head and body with facial features, hair and clothing accessories commensurate with the doll character or theme. However, concealed beneath a movable large covering or head flap, is a blank face constructed of a drawing medium.

The blank face provides the creative drawing opportunity for the child. The covering, with its permanently imprinted theme face, provides for initial child attraction. The child will become intrigued by the mystery of what might be beneath the flap. He/she will be excited with anticipation before the flap is lifted. Surprise and glee will result when the flap is finally lifted.

To further enhance the attractiveness of the invention, the doll head is provided with a double set of doll feature means. These may comprise two pairs of ears, two hair designs, two hats, two bows or other decorative items. A first set of doll features is observable when the flap is in the down position. A second set, that preferably corresponds to the first set, is concealed beneath the flap when in the down position. The second set becomes exposed when the flap is raised above the blank face.

An additional advantage of the invention is that the flap is provided with attachment means for releasable securement to the doll head. When the flap is secured in the down position, a child can play with the doll in the same manner as with any other conventional doll.

When the child wishes to draw faces, the flap can be folded back and conveniently secured against the back of the doll head. This facilitates and encourages play with the doll when the child has inscribed the blank face with a facial design.

DESCRIPTION OF THE PREFERRED EMBODIMENTS

Figure 1:
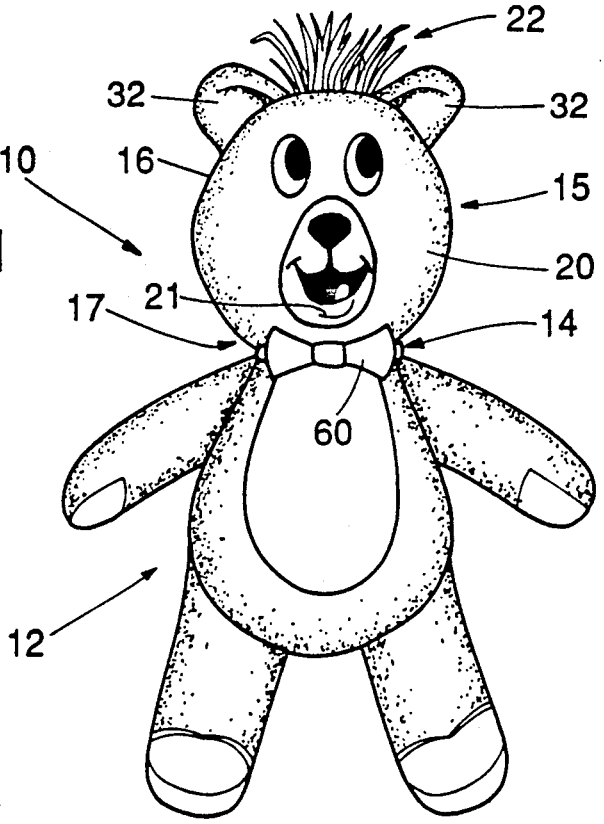
FIG. 1 is a front elevational view of a stuffed bear doll assembled in accordance with the invention having a movable head flap in the down position concealing a blank face.

In FIG. 1 of the drawings, a stuffed toy bear 10 is shown which embodies the novel features of the invention. Since the invention involves only modifications to the doll head, it can be adapted to a variety of doll types such as other animals, babies, clowns, comic heros and the like. As shown, the bear doll has a conventional body with arms and legs, shown generally by reference 12, having a neck portion 14 which connects with a modified head assembly 15.

The head assembly comprises a stuffed, hollow or solid head 16 that has a round or oblong outline. It has a rounded back side 18 and a flat or slightly convex front side 20. The overall top of the head is defined as a top region 22 which encompasses arcuate areas defined as forward section 26 and rearward section 28.

Overlying at least a major area of the front side 20 is a blank face plate 30 constructed of a smooth-surfaced drawing medium. Most conveniently, the medium comprises a sheet of plastic such as vinyl that has a relatively hard, somewhat glossy, waterproof surface. The medium must allow easy removal of non-permanent marking means such as crayons, watercolors, non-permanent inks and colored-pencil markings. Note that a basic purpose of the blank face is to allow a child to draw and remove an infinite variety of faces on the face plate.

The rearward section 28 of the top region includes a first pair of spaced-apart ears 32 and a tuft of hair 34. The ears are attached to opposing upper sides of the rearward section and the hair tuft extends outwardly from its securement to the middle portion of said section. Both the hair and ears must be flexible for a purpose to be hereinafter described.

Attached along a transverse portion of the rearward section, forward of said first pair of ears and hair tuft, is a large covering or head flap 36. The flap is preferably permanently secured along an arcuate line over the doll head by stitching or the like. However, it may be detachably secured by Velcro or other conventional fasteners known in the art.

The flap is constructed of cloth or other flexible material and should at least cover the face plate 30. As shown, it has a periphery corresponding to the outline of head 16 and includes an upper portion 38 which forms the attachment to said transverse portion of said rearward section.

In a similar manner, the flap includes a lower portion 42 having a bottom edge 44. Attached to the lower portion is a releasable attachment means for connecting the flap to the head lower region 17 which, as defined herein, includes the area below the doll chin 21 and the neck portion 14. Such means may comprise a snap or cloth fastener patch on the flap and a corresponding snap or hook fastener patch on the doll head lower region.

Figure 3:
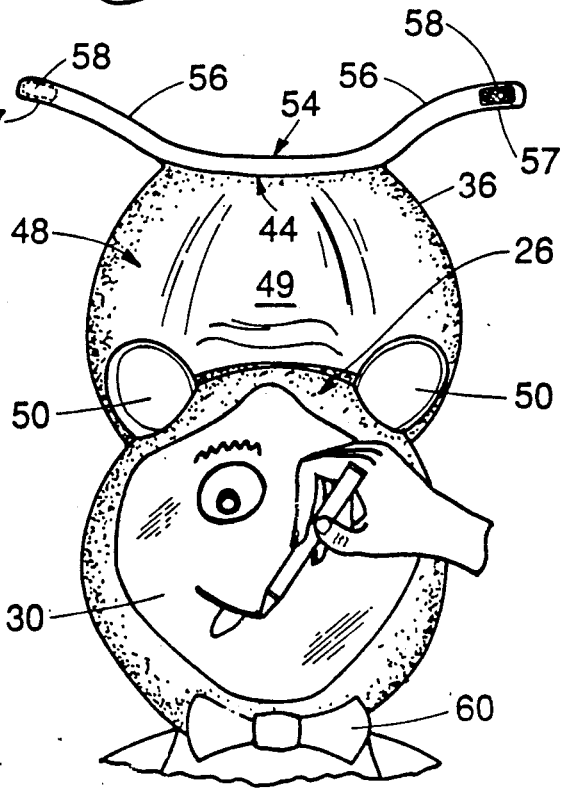
FIG. 3 is an enlarged front fragmentary elevational view showing the head and neck region of the doll of FIG. 1 with the head flap in a raised position including a child's hand in the process of drawing facial features on the blank face.

With particular reference to FIG. 3, the releasable attachment means comprises an elongated strap 54 attached to bottom edge 44. Extending beyond each side of the flap bottom edge are strap extensions 56. The tip ends 57 of each extension are provided with the above-described releasable securement means which, as shown, comprise corresponding patches 58 of a Velcro fastener. The combined length of the strap extensions are sufficient to encircle the neck portion and form an overlapping connection. Alternatively, the straps could simply be long enough to permit being tied together.

On the outerside 46 of the head flap is imprinted a face corresponding to the type of doll being produced. As shown in FIG. 1, a bear face is depicted which, themewise, relates to the body 12, hair tuft 34 and ears 32.

It is desirable that underside 48 of the flap also include a matching means such as a pattern or design that coordinates with the preexisting pattern or design of head back side 18. For example, if the doll has a polka dot hat, then the underside should include the same cloth or a pattern that matches polka dots. As shown, the underside comprises brown velvet cloth 49 which is the same cloth used on back side 18.

Figure 2:
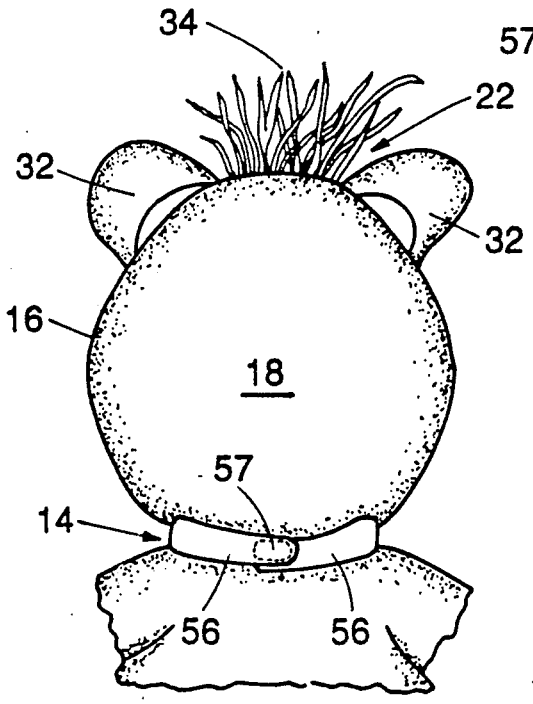
FIG. 2 is an enlarged fragmentary elevational rear view showing the shoulder and head of the doll of FIG. 1.
Figure 5:
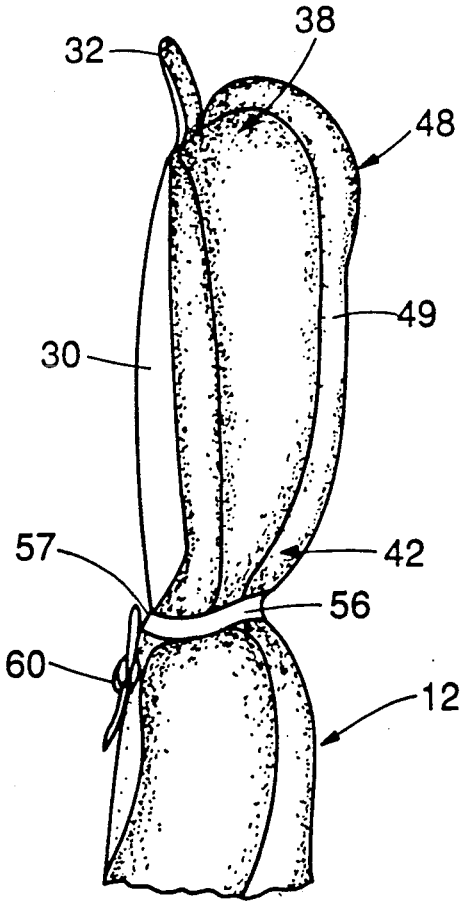
FIG. 5 is a view identical to FIG. 4 with the flap secured against the back side of the head.

The purpose of the flap underside matching means is so that the flap can be raised from a down position shown in FIGS. 1 and 2, to a reversed back position against the head back side as shown in FIG. 5. When so positioned, the flap underside becomes exposed along with whatever doll featurette was beneath the flap. In this way, at least some of the features originally displayed will continue to be depicted and the doll theme will be maintained regardless of the flap position.

Figure 4:
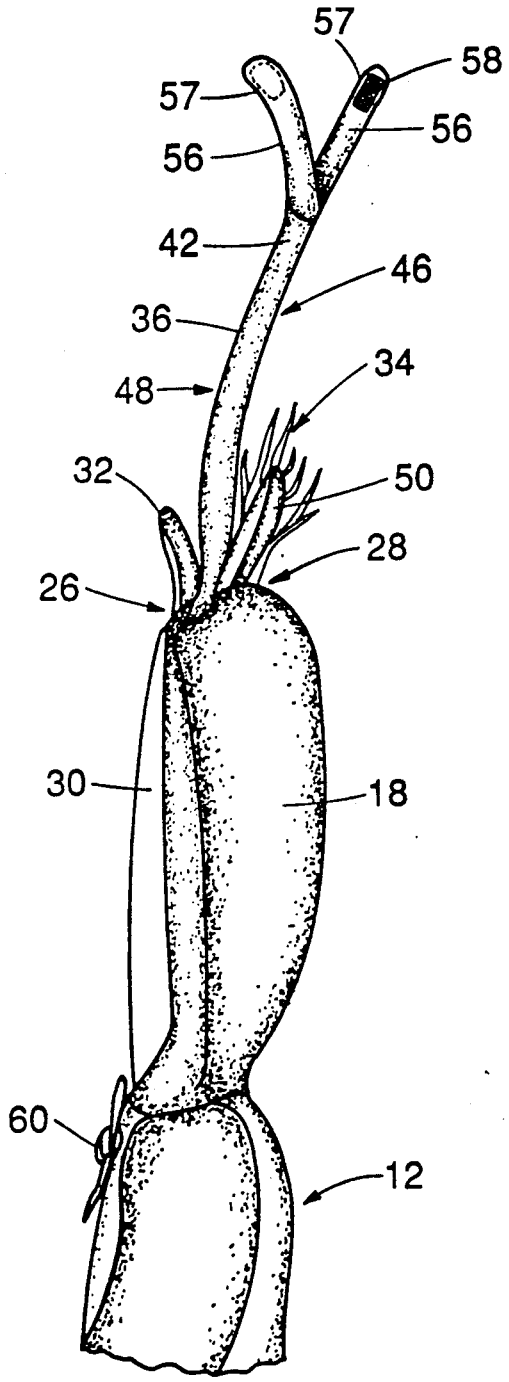
FIG. 4 is a right side elevational view of the doll shown in FIG. 3 without the child's hand holding a drawing means.

With reference to FIGS. 3 and 4, the bear doll features originally concealed by the flap comprise a second pair of spaced-apart ears 50. They are shown attached to opposing areas of the forward section 26 of the head top region. Other doll feature means may be attached to either the forward side 26 of the head top region or the flap underside 48. Examples of such means would be a hat, visor, bonnet, various hair arrangements, bows, ribbons and the like.

When the flap is in a down position, a portion of the opposing free end will overlap and attach together in the back of the neck portion. As so disposed, a child can simply play with the doll in a normal fashion. When the flap is in the reversed back side position, the opposing tip ends connect in the front of the neck portion behind bow tie 60. This allows the child to play with a doll having a face that they themselves created. In either of the above positions, the child can fully utilize the doll without the distraction of a loose flap getting in their way.

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a doll having a head with a top region, a lower region, a back side and a front side with said front side including a blank drawing medium; and, wherein said front side with said blank drawing medium is surface prepared to eraseably receive markings from a child's markers from the group of crayons, pencils, and felt tip pens, a flap constructed of flexible material removably overlying said medium having an outerside displaying a face design, said flap having an upper portion attached to said top region and a lower portion having a releasable attachment means for releasably securing said flap to said lower region, said flap being movable from a down position over said medium to a back position over said back side, said releasable attachment means being connectable to said lower region when said flap is in either the down position or the back position.

2. The doll of claim 1 wherein said lower region includes a neck portion and said releasable attachment means comprises detachable straps for encircling said neck portion.

3. The doll of claim 1 wherein said top region includes a first set of doll feature means on a rearward section of said top region and second set of doll feature means on a forward section of said top region.

4. The doll of claim 1 wherein said medium is constructed of a plastic plate and said flexible material comprises a fabric.

5. The doll of claim 1 wherein said flap is permanently secured to said top region and includes an underside having matching means for coordinating with the appearance of said doll.

6. The doll of claim 5 wherein said matching means comprises a fabric pattern or design.

* * * * *